US006737574B2

(12) United States Patent
Sylvia et al.

(10) Patent No.: US 6,737,574 B2
(45) Date of Patent: May 18, 2004

(54) DETECTABLE CABLE TAPE

(75) Inventors: Joseph M. Sylvia, Cranston, RI (US); L. Dwayne Garrett, Lenoir, NC (US)

(73) Assignee: Neptco Incorporated, Pawtucket, RI (US)

( * ) Notice: Subject to any disclaimer, the term of this patent is extended or adjusted under 35 U.S.C. 154(b) by 0 days.

(21) Appl. No.: 10/205,095

(22) Filed: Jul. 25, 2002

(65) Prior Publication Data

US 2004/0016566 A1 Jan. 29, 2004

(51) Int. Cl.[7] ..... H01B 7/34
(52) U.S. Cl. ..... 174/36
(58) Field of Search ..... 174/36, 110 R, 174/113 R, 117 R, 117 F, 117 FF

(56) References Cited

U.S. PATENT DOCUMENTS

| | | | | | |
|---|---|---|---|---|---|
| 4,559,411 | A | * | 12/1985 | Piper | 174/117 M |
| 4,712,298 | A | * | 12/1987 | Mondor, III | 29/861 |
| 4,746,769 | A | * | 5/1988 | Piper | 174/117 M |
| 4,781,958 | A | | 11/1988 | Gilbert | 428/76 |
| 4,804,806 | A | * | 2/1989 | Orr et al. | 174/117 M |
| 4,977,017 | A | | 12/1990 | Schneider | 428/229 |
| 4,988,236 | A | | 1/1991 | Ramsey et al. | 405/157 |
| 5,017,873 | A | | 5/1991 | Rippingale et al. | 324/326 |
| 5,102,727 | A | * | 4/1992 | Pittman et al. | 442/187 |
| 5,106,175 | A | | 4/1992 | Davis et al. | 385/100 |
| 5,305,410 | A | | 4/1994 | Arroyo | 385/109 |
| 5,349,991 | A | | 9/1994 | Okawa et al. | 139/391 |
| 5,373,103 | A | * | 12/1994 | Orr et al. | 174/36 |
| 5,380,954 | A | * | 1/1995 | Orr, Jr. | 174/117 M |
| 5,426,716 | A | | 6/1995 | Arroyo et al. | 385/100 |
| 5,454,404 | A | | 10/1995 | Okawa | 139/54 |
| 5,577,147 | A | | 11/1996 | Arroyo et al. | 385/109 |

OTHER PUBLICATIONS

C & M Corporation, Engineering Design Guide, (3rd Edition), p. 2, Jan. 1992.*

* cited by examiner

*Primary Examiner*—William H. Mayo, III
(74) *Attorney, Agent, or Firm*—Mintz, Levin, Cohn, Ferris, Glovsky and Popeo, P.C.

(57) ABSTRACT

A detectable woven tape having multiple metallic conductors for use in detection of underground dielectric communications cable is provided. The tape provides low electrical resistance at a range of frequencies to help to permit detection of buried cable in different field conditions using commercially available detection equipment. In particular, the tape helps to provide detection of buried cable over a long distance or over a long span of conduit. The tape is lightweight and flexible and suited for use in detecting and installing fiber optic communications cable.

33 Claims, 2 Drawing Sheets

DETECTABLE CABLE TAPE

FIELD OF THE INVENTION

The invention is directed generally to a tape for detecting concealed cable and conduit systems. More particularly, a detectable woven tape is provided having metallic conductors for locating underground dielectric (non-metallic) cable such as fiber optic communications cable.

BACKGROUND OF THE INVENTION

With increasing use of all dielectric cable in data communications and telecommunications systems, a need exists for reliable and economical methods for detecting dielectric cable, such as fiber optic cable, in underground systems. Such detection methods are needed to reduce the costs typically associated with location and maintenance of dielectric cable and to minimize the disruption in cable communications services.

Prior art detection methods include incorporating a magnetic presence with one or more components of a dielectric cable that does not adversely affect cable performance. For instance, U.S. Pat. No. 5,305,410 discloses incorporating magnetic particles with existing strength members of a cable, and U.S. Pat. No. 5,577,147 discloses use of a polymer matrix layer including magnetic materials to form a detectable layer of a cable sheathing system. Among other prior art detection methods, U.S. Pat. No. 5,017,873 discloses helically wrapping a cable in a magnetic tape including a magnetic powder, or magnetizing a length of a conduit, such that the magnetic tape or magnetized conduit emits a "magnetic field signature". The "magnetic field signature" provides a distinct detection signal that allows an underground dielectric cable to be distinguished from surrounding metallic piping. In addition, as disclosed in U.S. Pat. No. 5,106,175, electronically resonant markers or tags are incorporated with a cable sheathing system for locating a cable by electromagnetic signals.

A disadvantage of prior art magnetic materials is that such materials must be incorporated with cable components during cable manufacturing before installation. Adding magnetic materials to one or more cable components during manufacturing may require additional process steps, increasing production time and manufacturing costs. In addition, prior art magnetic materials as described above do not address the problem of locating previously installed dielectric cable.

Other prior art detection methods include adding a metallic presence to one or more components of dielectric cable. A remote transmitter/receiver is used to locate a buried cable by detecting an electrical signal (field) emitted from a metallic presence on or within the cable as a result of the application of an electrical current to the cable. Copper wire is commonly used as a detector and typically applied to underground dielectric cable as a permanent service cable. Copper wire provides a relatively easy and inexpensive detection method. In such applications, however, copper wire is particularly susceptible to corrosion and lightening strikes due to its relatively exposed nature and, thus, is preferably located within conduits or incorporated with cable components.

To that end, different types of prior art cable tapes including metallic components are applied to dielectric cable to allow detection. For instance, water blocking tape used to wrap insulated optical fibers of dielectric cable may include a metallic conductor, such as a copper conductor, for detection. Also, cable tape used to measure lengths of conduit and to pull cable through innerducts for installation may include a copper conductor to add a metallic presence to dielectric cable.

A disadvantage of prior art tape is the electrical signal (field) that the metallic presence emits is insufficient to locate cable along a long length of conduit. Prior art metallic tapes exhibit low conductivity and high resistance, but cannot reliably locate buried dielectric cable over a long span.

In addition, prior art metallic materials must be applied or incorporated with a dielectric cable or one or more cable components during manufacturing. In the case of metallic (copper) service cables or tracer wires, the cables or wires are applied to a conduit system during installation. Such prior art detection materials do not address the problem of determining the location of existing underground dielectric cable previously installed without a metallic or magnetic presence.

Current methods for locating existing underground dielectric cable for repair and maintenance include exploratory drilling, known as posthole drilling, which is a slow and often costly and unreliable detection method that poses the risks of accidentally damaging or destroying buried cables.

Thus, a detectable tape is needed that includes electrical conductivity and resistance sufficient to help provide reliable and accurate signal detection to locate underground cable over a long distance or a long span of conduit. A detectable tape for use with commercially available detection equipment that provides reliable detection at a wide range of frequencies is required. A detectable tape is needed that is easily applied and not restricted to a method of application to cable.

SUMMARY OF THE INVENTION

A detectable woven tape is provided for use in determining a location of an underground cable, e.g., dielectric communications cable. A detectable woven tape is provided having multiple metallic conductors that provide enhanced conductivity and low electrical resistance. The tape provides a highly functional low resistance at a wide range of frequencies to help facilitate accurate and reliable location of an underground dielectric cable over a long distance or a long span of conduit. Low resistance helps permit use of the tape with commercially available equipment to locate cable under different field conditions The tape has high tensile strength sufficient for use of the tape in other applications, e.g., measuring lengths of conduit and pulling cable through innerducts for installation. The tape is lightweight and flexible, and particularly suited for use in installing and detecting fiber optic communications cable.

In one embodiment, a detectable woven tape comprises a plurality of elongated warp yams grouped into a plurality of substantially parallel bundles. Each bundle includes a certain number of warp yarns. The tape includes three or more elongated metallic conductors, wherein each metallic conductor is substantially parallel to and adjacent one or more bundles. The tape further includes a plurality of elongated weft yarns extending across the bundles and the metallic conductors. Each weft yarn is interlaced with each warp yarn and each metallic conductor. The tape includes at least one elongated fixing yarn arranged substantially perpendicular to the plurality of weft yarns and interlaced with each weft yarn.

Embodiments of the invention may also include one or more of the following features. The metallic conductors are alternately arranged with the bundles. Each weft yarn is substantially equally spaced from and substantially parallel to adjacent weft yarns. Each weft yarn interlaces above every other warp yarn and every other metallic conductor. The warp yarns and the weft yarns are polyester yarns. Each warp yarn and/or each weft yarn includes a denier in a range of from about 1000 to about 4000, and preferably about 2600. The fixing yarn is polyester yarn. The fixing yarn includes a denier in a range of from about 200 to about 1400, and preferably about 840. The warp yarns, the weft yarns and the one fixing yarn include a low coefficient of friction. The low coefficient of friction of the plurality of warp yarns, the plurality of weft yarns and the at least one fixing yarn is in a range of from about 200 to about 1400. The woven tape includes a coating of lubricant.

Embodiments of the invention may further include one or more of the following features. Each metallic conductor includes a gage in a range of from about 15 ga to about 30 ga, and preferably about 22 ga. Each metallic conductor includes a resistance of less than about 5 ohms per 1,000 feet (ohms/mft), or a resistance of from about 4.4 ohms per 1,000 feet (ohms/mft) to about 4.9 ohms/mft. The metallic conductors include copper conductors. The woven tape includes four copper conductors. The woven tape includes a plurality of markings wherein each marking is substantially equally spaced from an adjacent marking indicating a unit of length.

BRIEF DESCRIPTION OF THE DRAWINGS

For a better understanding of the invention, reference is made to the drawings described below, which are incorporated herein by reference. The drawings are for illustrative purposes and do not limit the scope and spirit of the invention.

DETAILED DESCRIPTION OF THE INVENTION

Illustrative embodiments of the invention provide a tape for locating concealed communications cable. More particularly, a detectable woven tape is provided having multiple metallic conductors for use in locating buried dielectric (non-metallic) communications cable. The tape provides enhanced conductivity and low electrical resistance at a wide range of frequencies. The tape helps to facilitate accurate and reliable location of underground dielectric cable under different field conditions. In particular, the tape helps to provide accurate and reliable location of cable over long distances and/or along long spans of conduit. The tape can be used with commercially available detection equipment.

The detectable woven tape is lightweight and flexible, and particularly suited for use in installing and/or detecting fiber optic communications cable. The tape has a high tensile strength sufficient to permit use of the tape in other applications, e.g., measuring lengths of conduit and pulling cable through innerducts for installation of conduit systems. Other embodiments of the detectable woven tape are within the scope of the invention.

Figure 1:
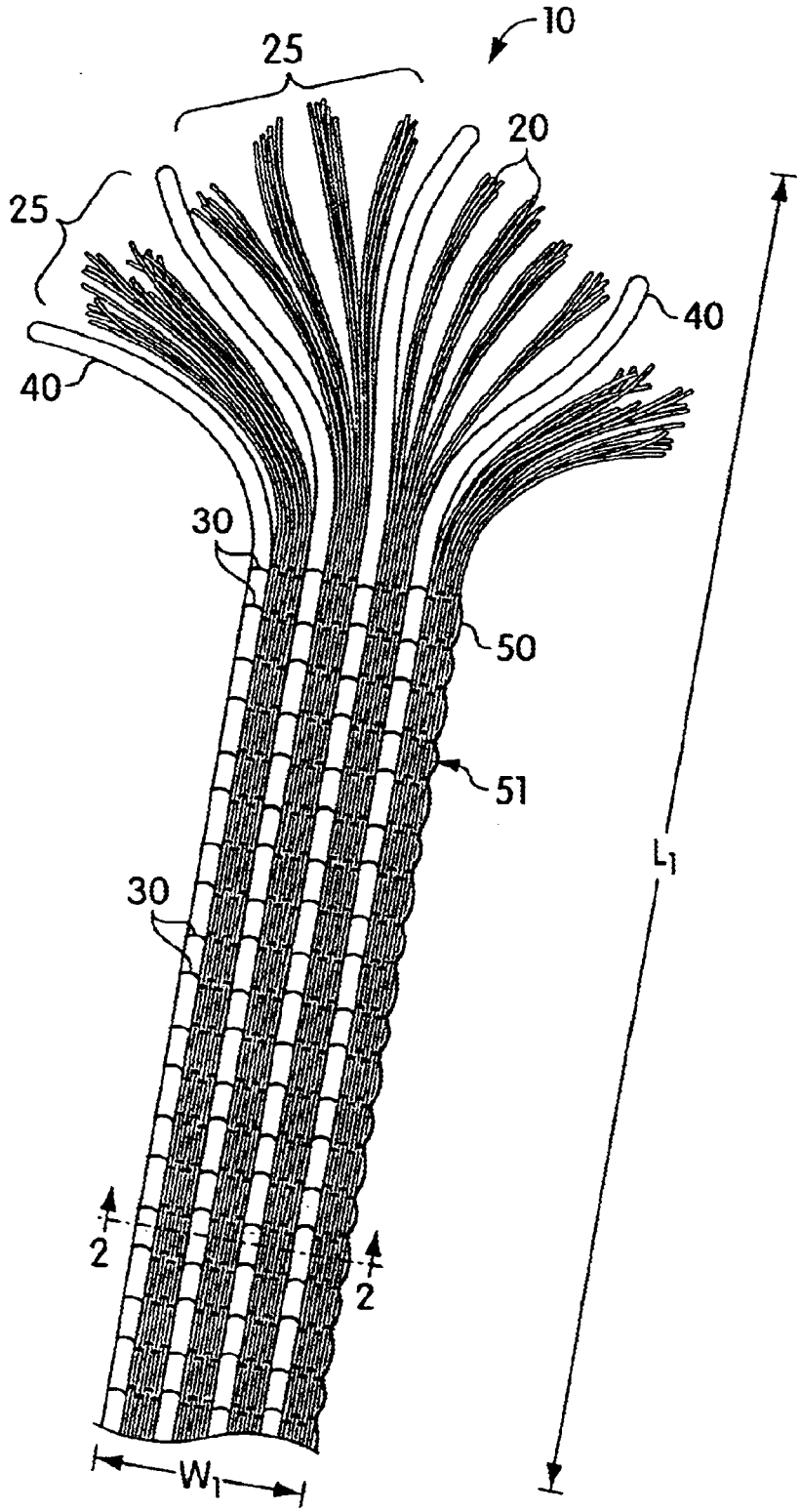
FIG. 1 is a perspective view of a detectable woven tape.

Referring to FIG. 1, a first embodiment according to the invention provides a detectable woven tape 10 comprising a plurality of yarns 20, 30 and 50 woven with multiple metallic conductors 40 in a preferred weave, e.g., a plain weave or a flat chain weave. The tape has a width $W_1$) of from about 1.0 cm to about 2.0 cm, and preferably about 1.5 cm, and a thickness of about 1.0 mm to about 1.5 mm and preferably about 1.3 mm. The width $W_1$ and thickness of the tape help to accommodate different cable designs and a range of cable duct dimensions. The tape can be provided on reels in a desired or required length to accommodate different applications of the tape and different lengths and/or spans of conduit.

Figure 2:
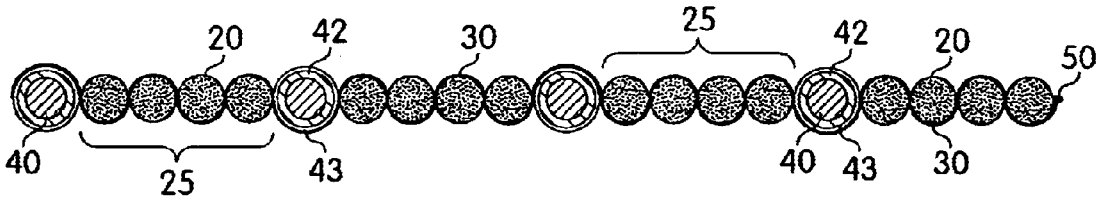
FIG. 2 is a cross-sectional view of the tape shown in FIG. 1.

Referring to FIGS. 1–2, the tape 10 comprises a plurality of warp yarns 20 grouped together to form one or more bundles 25. Each bundle 25 includes a certain number of warp yarns 20. In a first aspect of the first embodiment, the plurality of warp yarns 20 is grouped to form four bundles 25. Each bundle 25 includes four warp yarns 20 for a total of sixteen warp yarns 20. The bundles 25 are substantially parallel. The bundles 25 are alternately arranged with the metallic conductors 40 such that the metallic conductors are substantially parallel to one or more adjacent bundles. The warp yarns 20 and the metallic conductors 40 are arranged to extend longitudinally to define a length $L_1$ of the tape. The invention, however, is not limited to the number of bundles 25, warp yarns 20 or metallic conductors 40 shown in FIG. 1, but anticipates the tape 10 can include any suitable number of bundles 25, warp yarns 20 and metallic conductors 40 as desired or required to help accommodate an application of the tape.

The tape 10 further comprises a plurality of weft yarns 30. Each weft yarn extends across the width $W_1$ of the detectable tape to interface with the plurality of warp yarns 20 and the metallic conductors 40. Each weft yarn 30 is substantially equally spaced from and substantially parallel to adjacent weft yarns. As shown in FIG. 2, each weft yarn 30 alternately interlaces above one of the warp yarns and the metallic conductors and then weaves below one of the warp yarns and the metallic conductors across the width $W_1$ of the tape to thereby weave the warp yarns 20 and the metallic conductors 40 in a suitable weave, e.g., a plane or a flat weave.

The tape further comprises at least one fixing yarn 50 that extends longitudinally along the length $L_1$ of the tape to fix or tic off each of the weft yarns 30. The fixing yarn 50 extends longitudinally along a longitudinal edge 51 of the tape and is arranged substantially perpendicular to the weft yarns. The fixing yarn 50 interlaces with each weft yarn 30 to help secure the weave of the weft yarns, the warp yarns and the metallic conductors.

The warp yarns 20, the weft yarns 30 and the fixing yarn 50 are constructed of a suitable material including, but not limited to, aramid fibers, polyethylene fibers, polypropylene fibers, polyester fibers, other suitable fibers and some combination thereof. The warp yarns 20, the weft yarns 30 and the fixing yarn 50 are preferably constructed of polyester.

Each warp yarn 20 has a denier in a range of from about 1000 to about 4000, and preferably about 2600. In the first aspect of the first embodiment according to the invention, the plurality of warp yarns 20 comprises a plurality of polyester warp yarns. Each warp yarn 20 constitutes a single-ply (one-ply) yarn including about 384 strands of multifilament polyester fibers to form an untwisted-ply yarn. Each warp yarn, however, can include any number of strands of a suitable material to achieve a woven tape with a desired or required.

Each weft yarn 30 has a denier in a range of from about 300 denier to about 1300, and preferably about 840. In the first aspect of the first embodiment, the plurality of weft yarns 30 comprises a plurality of polyester weft yarns. Each weft yarn constitutes a single-ply (one-ply) yarn including about 192 strands of multifilament polyester fibers to form an untwisted-ply yarn. Each weft yarn can include any number of strands of a suitable material as required or desired.

The fixing yarn 50 has a denier in a range of from about 300 to about 1300, and preferably about 840 denier. In the first aspect of the first embodiment, the fixing yarn includes any number of strands in a range from about 180 to about 200 to achieve a desired or required weight or strength.

The tape according to the first aspect of the first embodiment can comprise the polyester warp yarns 20 having a denier of about 2600, the polyester weft yarns 30 having a denier of about 840, and the polyester fixing yarn having a denier of about 840 to provide the tape with a minimum tensile (break) strength of about 568 kg (1,250 lb). Yarns, however, are not limited to any particular denier ranges, but may comprise any suitable materials having a denier (weight) sufficient to achieve a woven tape with strength and flexibility as required.

Polyester yarn is a preferred material of construction of the warp yarns, the weft yarns and the fixing yarns because of its low cost, light weight and high tensile strength. The resulting tape is lightweight and highly flexible and suitable for application to fiber optic cable. The tape also has a minimum tensile (break) strength sufficient to permit the tape to be used in other applications, e.g., installing fiber optic cable, wherein the tape is attached to a fiber optic cable and pulled through an empty innerduct to install the cable. The tensile strength of the tape also allows the tape to be used in measuring long spans of cable conduit, wherein the tape is inserted into an empty conduit and pulled through the empty innerduct to measure the conduit span.

Polyester yarn is also preferred because it imparts high abrasion resistance and a low friction coefficient to the resulting tape. In one embodiment, the tape is also lubricated during manufacturing with a suitable lubricant such as, although not limited to, silicone, wax, and oil to enhance a low friction coefficient. As a result, the tape of the first aspect of the first embodiment comprises a low friction coefficient of from about 0.10 to about 0.20.

The low friction and high abrasion resistance of the tape help to prevent or at least substantially reduce a common problem of "burn-through" that occurs during installation of fiber optic cable. "Burn-through" refers to the cutting and melting of a conduit, such as a high-density polyethylene conduit, as a result of the excessive friction caused by a cable pull rope during cable installation. The pull rope rubs against an inner wall of a conduit, and/or saws against an angle or bend in the inner wall of the conduit, as the pull rope pulls a fiber optic cable through an innerduct. The excessive friction of the pull rope against the inner wall burns through the conduit and exposes the fiber optic cable. The sawing action of the pull rope against angles and bends in the inner wall creates jagged segments within the innerduct. The jagged segments can score and shred a jacket of the fiber optic cable during the pulling action such that the shape and size of an inner core of the cable containing optical fibers is damaged.

The detectable woven tape helps to avoid or at least substantially reduce "burn-through" due to its low friction and high abrasion resistant properties. Field tests conducted to assess the performance of the detectable woven tape demonstrate that the tape can pull a fiber optic cable through a conduit including a length of from about 0.1 km to about 2 km with a number of bends and/or angles without causing "burn-through" or damage to the cable.

Referring to FIGS. 1–2, in the first embodiment of the tape according to the invention, the warp yarns 20, the weft yarns 30 and the fixing yarn 50 are woven with a multiple of metallic conductors 40. Four metallic conductors 40 are alternately arranged with and substantially adjacent and longitudinal to the four bundles of warp yarns 25. The tape as shown in FIGS. 1–2 includes four metallic conductors 40, however, the invention is not limited by the number of metallic conductors, but anticipates a suitable number of metallic conductors having a suitable gage to help accommodate detection of the tape in different cable applications.

The four metallic conductors 40 are constructed of a suitable conductive metal including, but not limited to, steel, aluminum and copper. In the first aspect of the first embodiment, the four metallic conductors 40 include four copper wire conductors 40. Each copper conductor 40 has a gage in a range of from about 16 ga to about 30 ga, and preferably about 22 ga, and a diameter in a range of from about 0.010 inch to about 0.045 inch, and preferably 0.0253 inch. Metallic conductors of larger gage can increase the conductivity of the tape. Larger gage conductors, however, can cause the tape to be undesirably stiff and/or heavy. Increased stiffness from multiple conductors can cause the tape to be less suited for application to fiber optic cable.

In the first aspect of the first embodiment, the tape 10 including four metallic conductors 40, as described above, has a total weight of about 16.82 lbs/1,000 feet. Such tape 10 is particularly suited for use with fiber optic cable and for installing cable. In addition, the tape 10 is suited for application to previously installed underground dielectric cable, and can be used in well known methods to install a metallic presence to existing cable.

The four copper conductors 40 as shown in FIGS. 1–2 provide the tape with low electrical resistance that is highly functional at a wide range of frequencies. In the first aspect of the first embodiment, each copper conductor 40 has a low resistance in a range of about 4.4 ohms per 1,000 feet (ohms/mft) to about 4.9 ohms/mft. The low resistance of the tape helps to facilitate accurate and reliable detection of buried dielectric cable over a long distance or a long span of conduit. The four copper conductors 40 provide the tape with enhanced conductivity.

In addition, the highly functional low resistance of the tape over a wide range of frequencies permits the tape to be used with a commercially available transmitter/receiver to determine the location of dielectric cable under a variety of field conditions. For example, the tape helps facilitate accurate and reliable detection of a specific underground dielectric cable in an area densely populated with conduit systems that requires high frequencies to locate the correct cable.

In one embodiment, each copper conductor 40 has a tin coating 42 to help prevent corrosion from moisture often present in conduit systems. Each copper conductor is further covered with an insulating layer 43 to provide electrical insulation. The insulating layer 43 includes, but is not limited to, a layer of heat resistant polymer, such as polyethylene, polypropylene, polyvinyl chloride, and preferably nylon. In the first aspect of the first embodiment, each copper conductor 40 includes a thin layer of nylon with a thickness in a range of from about 0.0001 inch to about 0.020, and preferably about 0.008 inch.

The first embodiment according to the invention provides a versatile detectable woven polyester tape having multiple metallic conductors to provide a resistance sufficient to detect underground dielectric cable over a long distance or along a long span of conduit. The tape is lightweight and flexible having high tensile strength sufficient for use of the tape in other applications, e.g., measuring spans of conduit and installing cable. The tape has a low friction coefficient sufficient to prevent tearing and melting of conduits during installation of dielectric cable.

Various alterations, modifications and improvements to the above description will readily occur to those skilled in the art. Such alterations, modifications and improvements are within the scope and spirit of the invention. Accordingly, the foregoing disclosure is by way of example only and is not limiting. The invention's limit is defined only in the following claims and the equivalents thereto.

What is claimed is:

1. A detectable woven tape for use with a cable, the tape comprising:

a plurality of elongated warp yarns grouped into a plurality of substantially parallel bundles, each bundle including a certain number of warp yarns;

three or more elongated metallic conductors, each metallic conductor being substantially parallel to and adjacent the bundles of warp yarns, and arranged between a pair of adjacent bundles of warp yarns;

a plurality of elongated weft yarns extending across the bundles and the metallic conductors, each weft yarn being interlaced with each warp yarn and each metallic conductor; and at least one elongated fixing yarn arranged substantially perpendicular to the weft yarns and longitudinally interlaced with a portion of each weft yarn disposed at an outermost edge of the tape such that the fixing yarn interlaced with the portions of the weft yarns define a first edge of the tape.

2. The woven tape of claim 1, wherein the metallic conductors are alternately arranged with an equal number of bundles of warp yarns.

3. The woven tape of claim 1, wherein each weft yarn is substantially equally spaced from and substantially parallel to an adjacent weft yarn.

4. The woven tape of claim 1, wherein each weft yarn interlaces above every other warp yarn and every other metallic conductor.

5. The woven tape of claim 1, wherein the warp yarns and the weft yarns are polyester yarns.

6. The woven tape of claim 5, wherein each warp yarn includes a denier in a range of from about 1000 to about 4000.

7. The woven tape of claim 5, wherein each weft yarn includes a denier in a range of from about 200 to about 1400.

8. The woven tape of claim 1, wherein the fixing yarn is polyester yarn.

9. The woven tape of claim 8, wherein the at least one fixing yarn includes a denier in a range of from about 200 to about 1400.

10. The woven tape of claim 1, wherein the warp yarns, the weft yarns and the fixing yarn include a low coefficient of friction.

11. The woven tape of claim 10, wherein the low coefficient of friction of the plurality of warp yarns, the plurality of weft yarns and the at least one fixing yarn is in a range of from about 200 to about 1400.

12. The woven tape of claim 1, further comprising a coating of lubricant.

13. The woven tape of claim 1, wherein each metallic conductor includes a gage in a range of from about 15 ga to about 30 ga.

14. The woven tape of claim 13, wherein each metallic conductor includes a resistance of less than about 5 ohms per 1,000 feet (ohms/mft).

15. The woven tape of claim 13, wherein each metallic conductor includes a resistance of from about 4.4 ohms per 1,000 feet (ohms/mft) to about 4.9 ohms/mft.

16. The woven tape of claim 1, wherein the metallic conductors include copper conductors.

17. The woven tape of claim 1, wherein the woven tape includes four copper conductors.

18. The woven tape of claim 1, further comprising a plurality of markings disposed longitudinally along the tape, wherein each marking is substantially equally spaced from an adjacent marking and a space between adjacent markings indicates a unit of length.

19. The woven tape of claim 1, wherein the warp yarns, the weft yarns and the fixing yarn are polyester yarns.

20. The woven tape of claim 19, wherein each warp yarn includes a denier in a range of from about 1000 to about 4000 and each weft yarn and the fixing yarn include a denier in a range of from about 200 to about 1400.

21. The woven tape of claim 20, wherein each metallic conductor includes a gage in a range of from about 15 ga to about 30 ga.

22. The woven tape of claim 21, wherein each metallic conductor includes a resistance of less than about 5 ohms per 1,000 feet (ohms/mft).

23. The woven tape of claim 21, wherein each metallic conductor includes a resistance of from about 4.4 ohms per 1,000 feet (ohms/mft) to about 4.9 ohms/mft.

24. The woven tape of claim 21, wherein the metallic conductors include four copper conductors.

25. The woven tape of claim 24, wherein the woven tape further comprises a total weight of about 16.82 lb/1,000 feet.

26. The woven tape of claim 24, wherein each metallic conductor includes a resistance of less than about 5 ohms per 1,000 feet (ohms/mft).

27. The woven tape of claim 24, wherein each metallic conductor includes a resistance of from about 4.4 ohms per 1,000 feet (ohms/mft) to about 4.9 ohms/mft.

28. The woven tape of claim 1, wherein a first bundle of warp yarns is disposed parallel to and extends longitudinally adjacent the first edge.

29. The woven tape of claim 1, wherein a first bundle of warp yarns is disposed parallel to and extends longitudinally adjacent the first edge, and a first metallic conductor is disposed at an opposite outermost edge of the tape and extends longitudinally to define a second edge of the tape.

30. A detectable woven tape for use with a cable, the tape comprising:

a plurality of elongated warp yarns grouped into a plurality of substantially parallel bundles, each bundle including a certain number of warp yarns;

a plurality of elongated metallic conductors alternately arranged with the bundles, each metallic conductor being substantially parallel to and adjacent the bundles;

a plurality of elongated weft yarns extending across the bundles and the metallic conductors, each weft yarn substantially equally spaced from and substantially parallel to adjacent weft yarns, each weft yarn being interlaced with each warp yarn and each metallic conductor; and at least one elongated fixing yarn arranged substantially perpendicular to the weft yarns and longitudinally interlaced with a portion of each weft yarn disposed at an outermost edge of the tape such that the fixing yarn interlaced with the portions of the weft yarns define a first edge of the tape.

31. The woven tape of claim 30, wherein each metallic conductor includes a gage in a range of from about 15 ga to about 30 ga.

32. The woven tape of claim 31, wherein each metallic conductor includes a resistance of less than about 5 ohms per 1,000 feet (ohms/mft).

33. A detectable woven tape for use with a cable, the tape comprising:

a plurality of elongated warp yarns grouped into a plurality of substantially parallel bundles, each bundle including a certain number of warp yarns;

a plurality of elongated metallic conductors, each metallic conductor being substantially parallel to and adjacent the bundles and disposed between a pair of adjacent bundles;

an elongated weft yarn arranged transversely to the bundles of warp yarns and the metallic conductors and being interlaced with each bundle of warp yarns and each metallic conductor; and at least one elongated fixing yarn arranged substantially perpendicular to the weft yarn and longitudinally interlaced with portions of the weft yarn disposed at an outermost edge of the tape such that the fixing yarn interlaced with the portion of the weft yarn define a first edge of the tape.

* * * * *